US005492201A

United States Patent [19]

Ericson et al.

[11] Patent Number: 5,492,201

[45] Date of Patent: Feb. 20, 1996

[54] METHOD AND APPARATUS FOR INSTALLING AND BALANCING AN ELEVATOR CAR

[75] Inventors: Richard J. Ericson, Southington, Conn.; T. Thomas Suchodolski, Ware, Mass.; Minglun Qiu, Bloomington, Ind.

[73] Assignee: Otis Elevator Company, Farmington, Conn.

[21] Appl. No.: 298,482

[22] Filed: Aug. 29, 1994

[51] Int. Cl.[6] ..... B66B 11/02; B66B 11/08

[52] U.S. Cl. ..... 187/401; 187/408; 187/412; 187/414

[58] Field of Search ..... 187/401, 405, 187/408, 412, 414

[56] References Cited

U.S. PATENT DOCUMENTS 808,042 12/1905 Gould ..... 187/401 X
4,716,989 1/1988 Coleman et al. ..... 187/414 X

FOREIGN PATENT DOCUMENTS 5246650 9/1993 Japan ..... 187/401 X

*Primary Examiner*—William E. Terrell
*Assistant Examiner*—Dean A. Reichard

[57] ABSTRACT

A method and an apparatus for installing and balancing an elevator car is disclosed. The method for installing and balancing an elevator car situated in a hoistway where cables attach to the car, is characterized by the following steps: providing an adjustable connector attached to the elevator car having two degrees of adjustable motion; positioning the connector to a desired location underneath the car, connecting the cables to the adjustable connector, and balancing the elevator car with an adjustable weight which is also attached to the underside of the elevator car. The apparatus for installing and balancing an elevator car having cables attached to its underside includes: (1) an adjustable connector attached to the elevator car having two degrees of adjustable motion; and, (2) an adjustable weight which attaches to the underside of the elevator car and is used to balance the car.

21 Claims, 7 Drawing Sheets

METHOD AND APPARATUS FOR INSTALLING AND BALANCING AN ELEVATOR CAR

BACKGROUND OF THE INVENTION

1. Technical Field

The invention relates to the installation of elevators in general, and to an apparatus and a method for balancing elevator cars in particular.

2. Background Information

A typical elevator system comprises an elevator car and a counterweight driven within a hoistway by a drive sheave. A plurality of hoist ropes connect the car and the counterweight, extending up from the car to the drive sheave at the top of the hoistway, and back down to the counterweight. When the car and counterweight are at the opposite ends of the hoistway, and the hoist ropes are therefore almost entirely on one side, the hoist ropes comprise a significant percentage of the weight drawn by the drive sheave. To offset the weight of the hoist ropes, it is known to use one or more compensating ropes extending from the car down the hoistway and back up to the counterweight. Compensating "ropes" may actually be cables or chains, depending on the application. Chains are often used in short run elevators.

A traveling cable may also be attached to the car. Traveling cables include a plurality of power and communications lines combined in to a single bundle extending between a fixed position in the hoistway and the car. Both the compensating ropes and the traveling cable are attached to the frame of the car in fixed positions after installation.

During installation of the elevator, the elevator car must be balanced to ensure proper operation of the elevator and to optimize the elevator ride. Correctly positioning and attaching the compensating ropes and the traveling cable relative to the car is an important part of the balancing process. One method for balancing the elevator car involves a weight assembly attached to the car isolation frame by a plurality of conventional fasteners. Each weight is positioned along the isolation frame member and set in place using a plate, a plurality of bolts and spring washers. The mechanic positions the weight where he or she believes it is necessary, fastens it to the frame member using the plates, bolts, and washers, and subsequently checks for balance.

A disadvantage of this balancing system is that the weights are cumbersome to attach to the frame member underneath the car. Specifically, the mechanic must either hold or prop each weight in place and at the same time position the plates and thread the fasteners for each weight. Another disadvantage of this system is that all the weights must be fixed in place before the car can be checked for balance. If the balance is not correct the first time, the weights must be unbolted (or the bolts must at least be loosened) and repositioned. Practically speaking, the weights are bolted, unbolted, moved, and rebolted several times during the process. A person of skill in the art will recognize that this is a time consuming job that often leads to inaccuracies.

DISCLOSURE OF THE INVENTION

It is, therefore, an object of this invention to provide an elevator car balancing technique that facilitates balancing the car and counterweight in the field.

It is another object of this invention to provide an elevator car installation technique that facilitates the attachments of the compensating ropes and traveling cable to the car and counterweight in the field.

It is a further object of this invention to maximize the life of compensating ropes or chains and traveling cables.

It is a still further object of this invention to provide adjustable positioning of a compensating chain or rope and a traveling cable on the underside of an elevator car.

According to the invention both a method and an apparatus for installing and balancing an elevator car is disclosed. The method for installing and balancing an elevator car situated in a hoistway where cables attach to the car, is characterized by the following steps: providing an adjustable connector attached to the elevator car having two degrees of adjustable motion; positioning the connector to a desired location underneath the car, connecting the cables to the adjustable connector, and balancing the elevator car with an adjustable weight which is also attached to the underside of the elevator car.

The apparatus for installing and balancing an elevator car having cables attached to its underside includes: (1) an adjustable connector attached to the elevator car having two degrees of adjustable motion; and, (2) an adjustable weight which attaches to the underside of the elevator car and is used to balance the car.

According further to the invention, the adjustable weight is shaped such that it can hang freely from the underside of the car without additional support.

There are several advantages to using the present invention. For instance, the present invention gives the installer several options when attaching the compensating ropes and traveling cable. Specifically, in certain circumstances it may be advantageous to use a plurality of adjustable connectors situated at different positions on the platform support frame of the car to facilitate balancing. The present invention allows the installer to position and attach the compensating ropes and traveling cable wherever best suits the job at hand. The position of the machine room in a hydraulic elevator, for example, can differ depending on the job. Adjustable connectors can facilitate the attachment of the hydraulic elevator traveling cable regardless of the machine room position.

A person of skill will also recognize that each compensating rope and traveling cable has a natural curve radius. The natural curve radius refers to the radius that the rope or cable will naturally assume when the ends of the rope are held above and the body of the rope or cable is allowed to hang freely and bend in a 180° turn. If the ends of the rope are brought together, assuming the length of the rope or cable to be sufficient, the rope or cable will not naturally curve at a radius less than its natural curve. An advantage to having the rope or cable hang at its natural curve is that it minimizes stress and strain in the rope or cable, and therefore extends the life of the rope or cable. Another advantage of having the rope or cable hang at its natural curve is that it helps prevent the ropes or cables from tangling on one another and/or on equipment within the hoistway.

The use of the adjustable weight also provides a simple and inexpensive method to balance the car. Since the balance weights hang freely on the underside of the car, field workers can appreciate the effect of each adjustable weight on the car prior to fastening the weight in place. Additionally, the workers can easily slide each weight to the necessary location and fasten them in place using a single fastener. Thus, if it is necessary to change the location of a compensating rope or traveling cable, the car can easily be rebalanced. In addition, the adjustable weights of the present invention do not require the disassembly of multiple components when attaching or removing them from the underside of an elevator car. Indeed, the process can be done using only one hand thereby making the job of balancing easier and more convenient.

The foregoing features and advantages of the present invention will become more apparent in light of the following detailed description of the best mode for carrying out the invention and accompanying drawings.

BEST MODE FOR CARRYING OUT THE INVENTION

Figure 1:
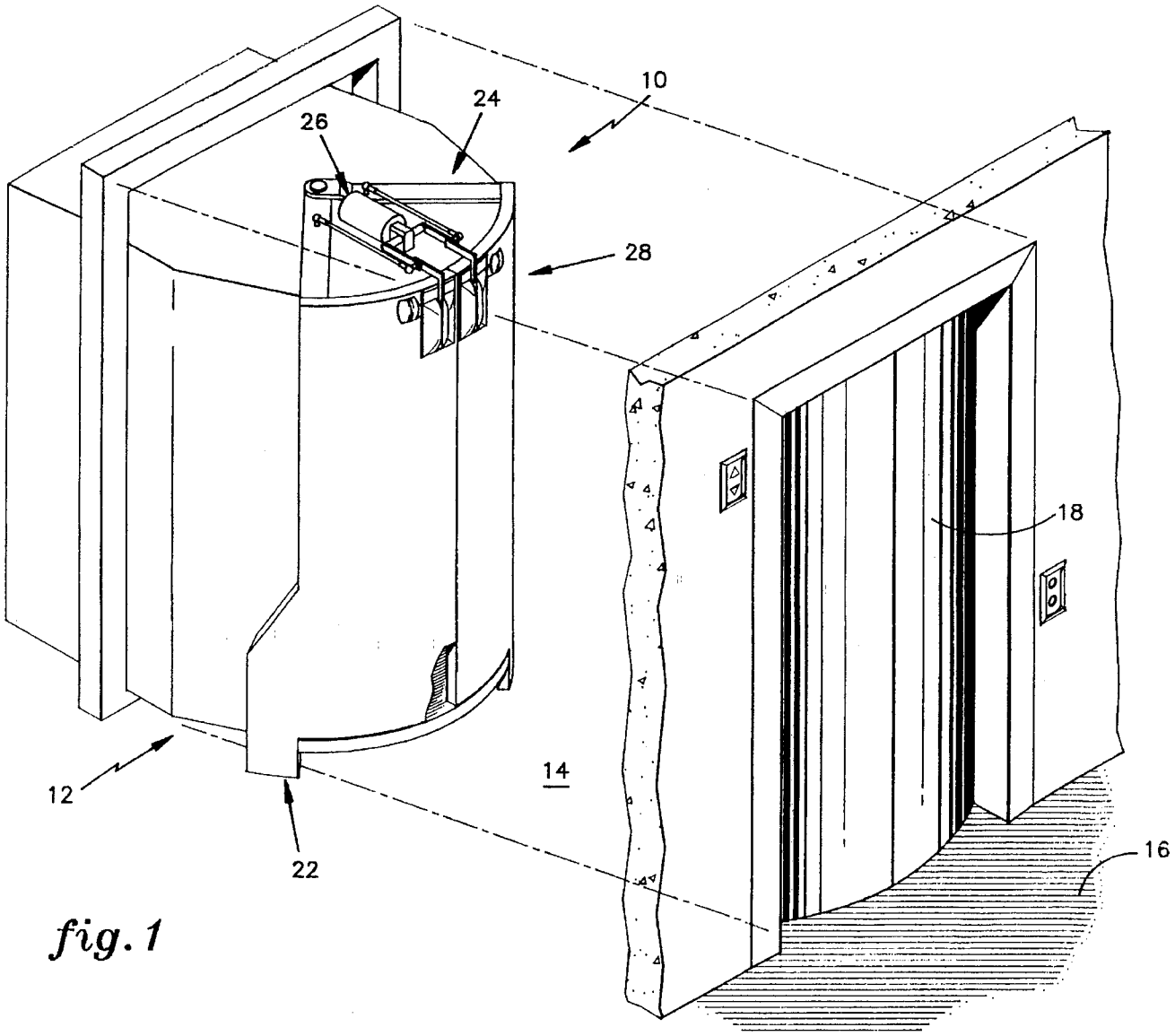
FIG. 1 is a perspective view of an elevator in a hoistway.

Referring to FIG. 1, an elevator includes an elevator car 10 and a counterweight 12 mounted in the hoistway of a building for travel between predetermined limits. The car 10 includes a frame 14 and a cab 16 attached to the frame 14. The elevator car 10 and the counterweight 12 are connected by a plurality of hoist ropes 18. The hoist ropes 18 extend up the hoistway from the car 10 around a drive sheave (not shown) and back down to the counterweight 12. One or more compensating ropes 20 extend from the car 10 down the hoistway and subsequently back up the hoistway to the counterweight 12. The weight of the compensating ropes 20 offsets the weight of the hoist ropes 18. One end of a traveling cable 24 is also attached to the underside of the car 10. The other end of the traveling cable 24 is attached to a fixed position 27 within the hoistway.

Figure 2:
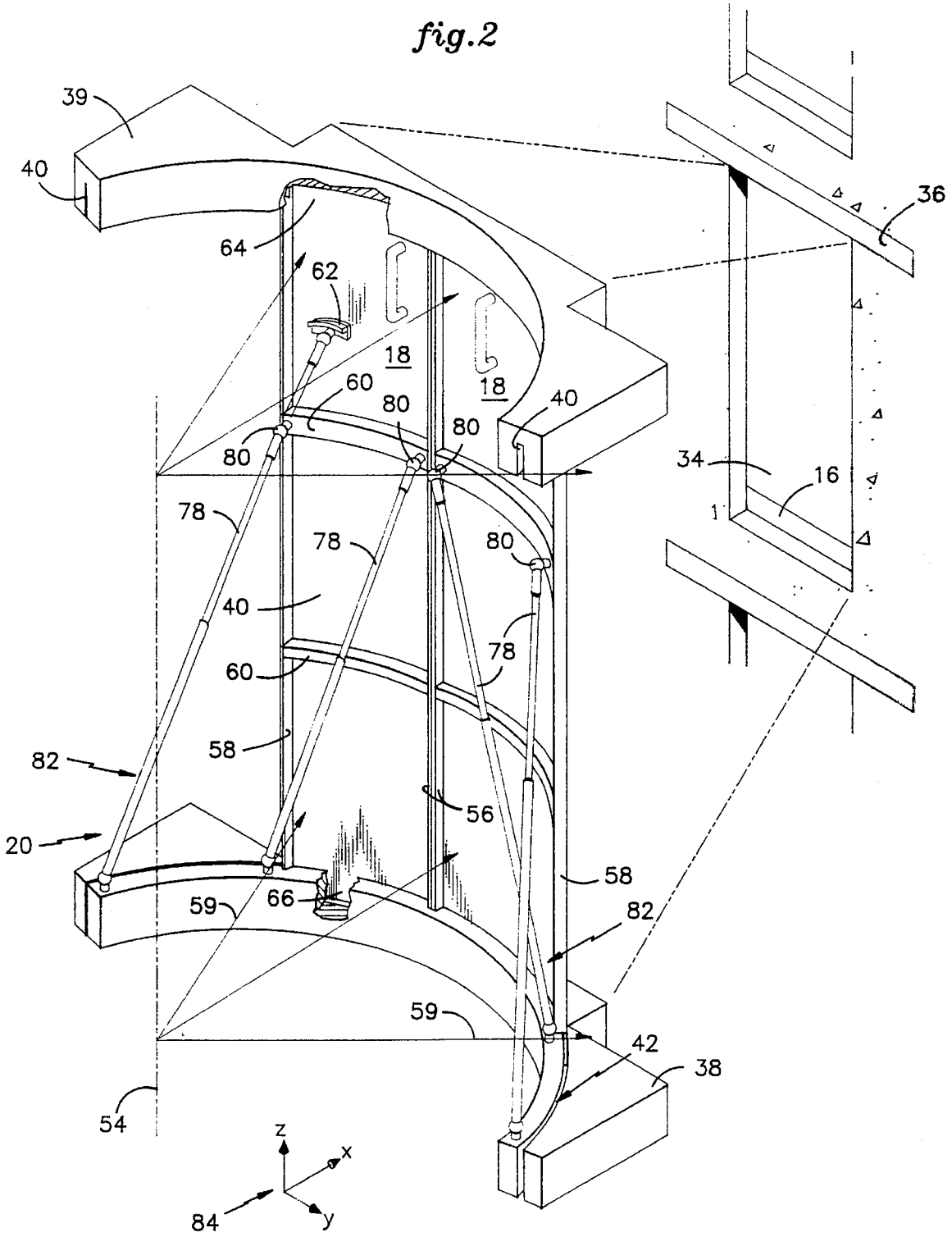
FIG. 2 is a perspective view of a platform support frame with an embodiment of the present invention.
Figure 3A:
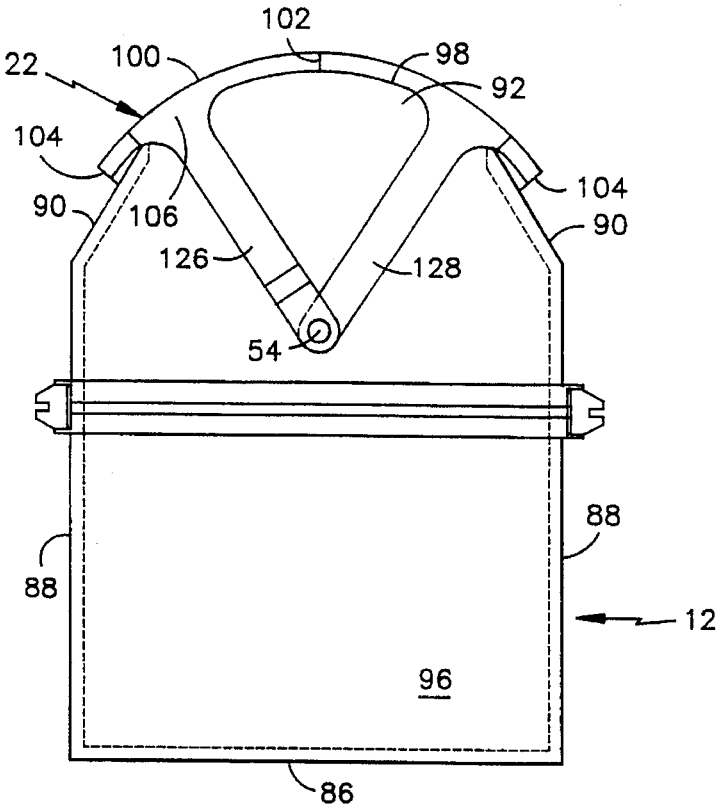
FIG. 3 is a cross-sectional partial view of FIG. 2.
Figure 3B:
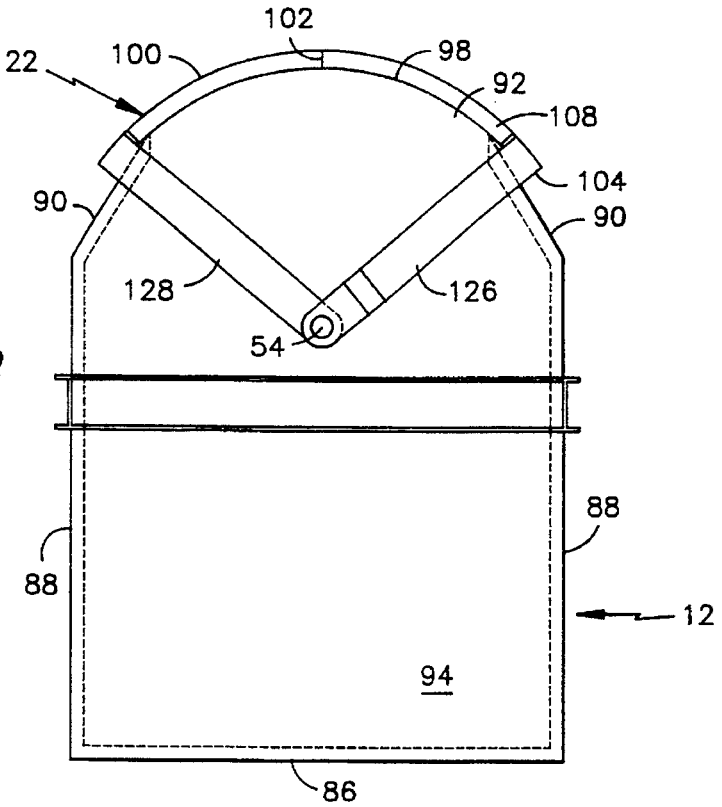

The hoist ropes 18, compensating ropes 20, and the traveling cable 24 shown in FIG. 1 all attach to a platform support frame 28 attached to the frame 14 of the car 10. The car frame 14 includes a pair of vertical stiles 32 connected on the top by a crosshead 34 and on the bottom by a safety plank 36. The platform support frame 28, as shown in FIG. 2, consists of a front member 38, a pair of center members 40, a rear member 42, and a pair of side members 44. For purposes of better illustrating the present invention, FIG. 2 shows the platform support frame 28 by itself, in a perspective view taken from below the platform support frame 28. The front 38, rear 42, and center 40 members have a "C"-shaped cross section. Small openings 46 (see FIG. 5) cut into the "C"-shaped cross-section permit the addition or removal of adjustable weights 48, as will be discussed infra. The front 38, rear 42, center 40 and side 44 members are conventionally attached to one another.

The Adjustable Connector

Figure 4:
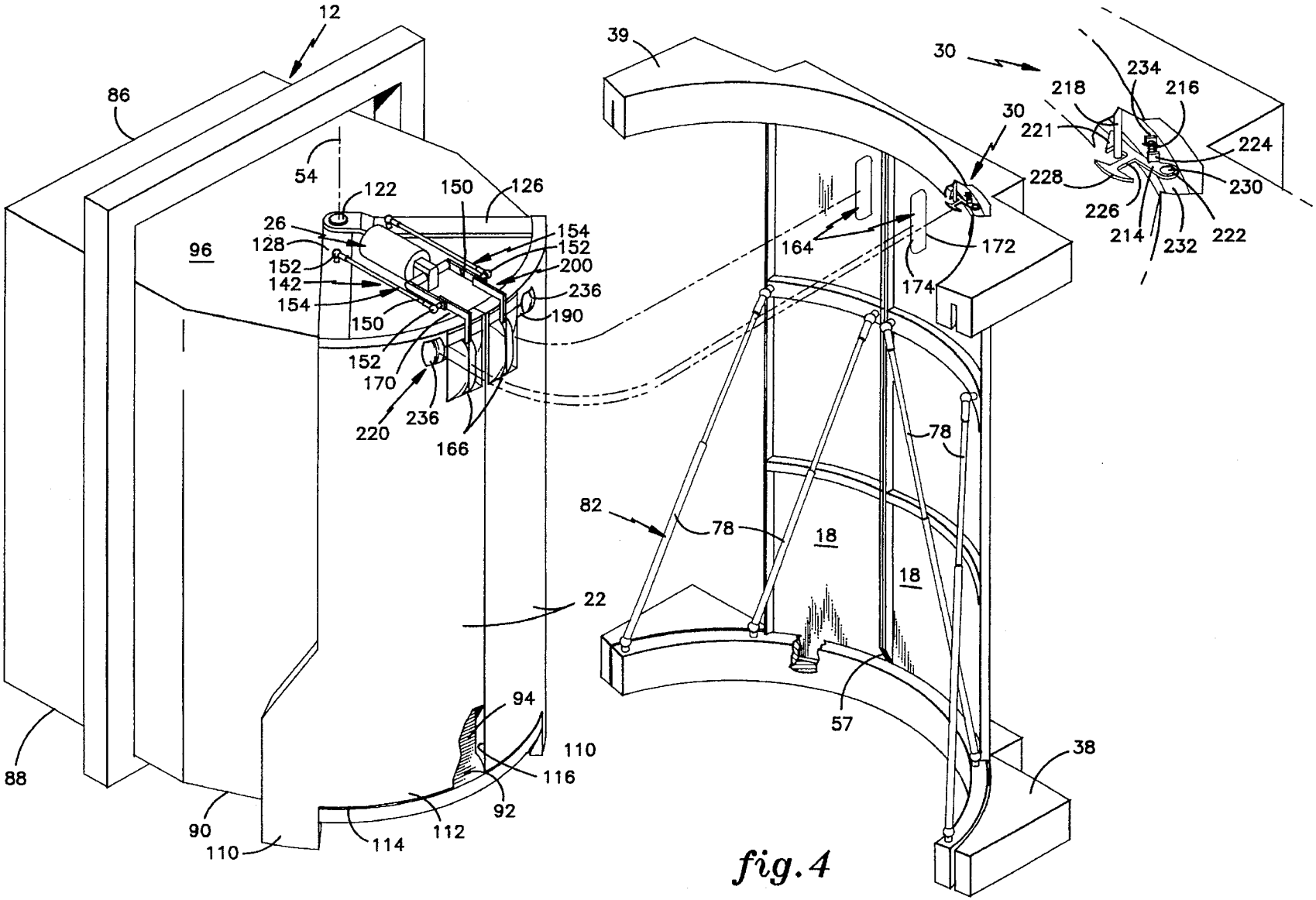
FIG. 4 is a cross-sectional partial view of FIG. 3.
Figure 3:
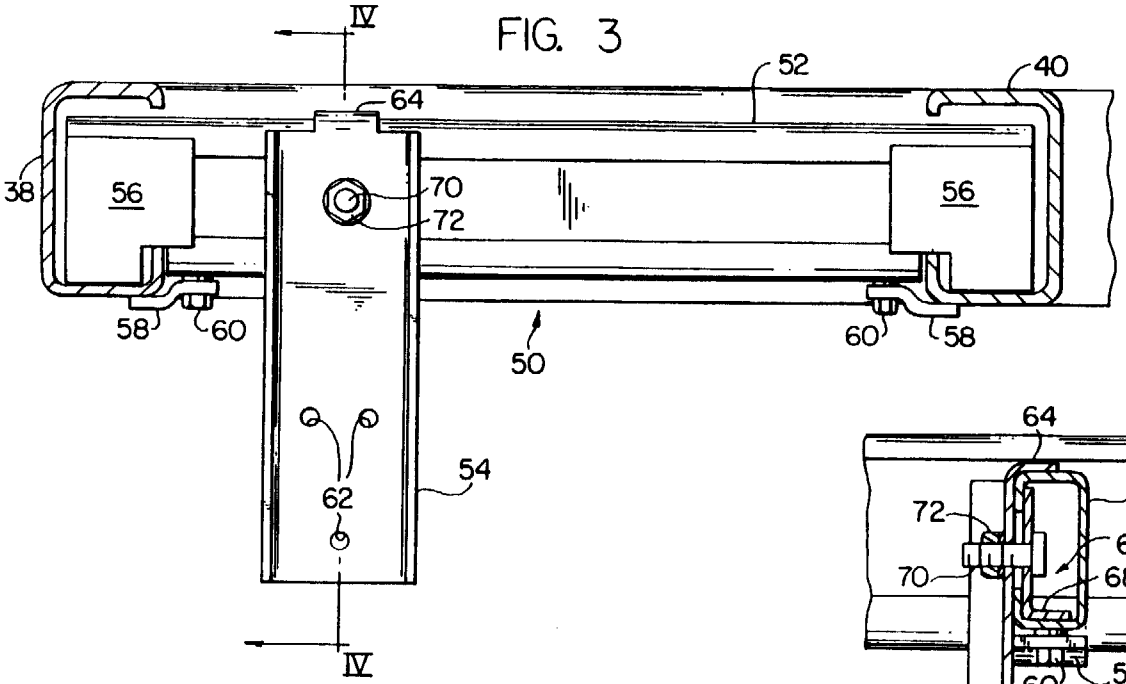
Figure 4:
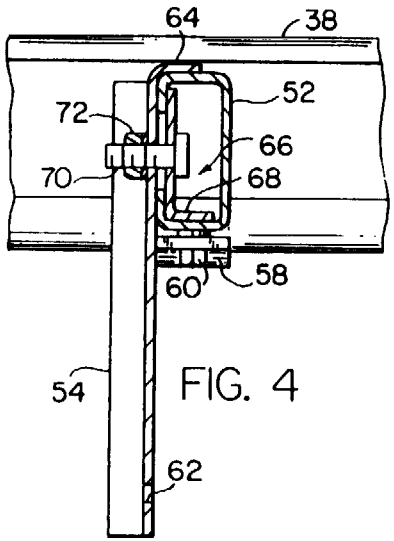

The platform support frame 28 further includes adjustable connectors 50 for connecting the compensating ropes 20 and traveling cable 24 (FIG. 1) to the platform support frame 28. Each adjustable connector 50, as shown in FIGS. 2–4, consists of a "C"-shaped beam 52 and a plate 54. The beams 52 extend between a center 40 member and one of either the front 38 or rear 42 member. A reinforcement flange 56 (FIG. 3) is attached to each end of the beam 52. The reinforcement flanges 56 fit over the opening of the "C"-shaped beam 52 and bends around a lower portion of the beam 52 to provide additional support. FIG. 2 shows three adjustable connectors 50 attached to the platform support frame 28. Commercially available rail clips 58, shown in FIGS. 3 and 4, are used to attach each beam 52 to one of the center members 40 and to one of the front 38 or back 42 members, depending on the application. Specifically, a rail clip 58 is fastened to the underside of each end of the beam 52 using a conventional fastener 60.

The plate 54 connected to each beam 52 allows for variable positioning along the beam 52. Holes 62 in each plate 54 (see FIG. 3) receive fasteners (not shown) for fixing the compensating ropes 20 (FIG. 1 ) or traveling cables 24 to the plate 54. The plate 54 includes a hooked flange 64 which rests on top of the beam 52. A clamping assembly 66 attaches the plate 54 to beam 52. The clamping assembly 66 (see FIG. 4) consists of an "L"-shaped bracket 68, a bolt 70, and a self locking hex nut 72. The "L"-shaped bracket 68 is positioned inside of the "C" shaped cross-section of the beam 52 and secured to the plate 54 by the bolt 70 and nut 72. The plate 54 may be slid along the length of the beam 52 to establish the correct position. The upper and lower lip of the beam 52 prevents the "L" shaped bracket 68 from sliding out of the "C"-shaped beam 52.

The Adjustable Weight

Figure 5:
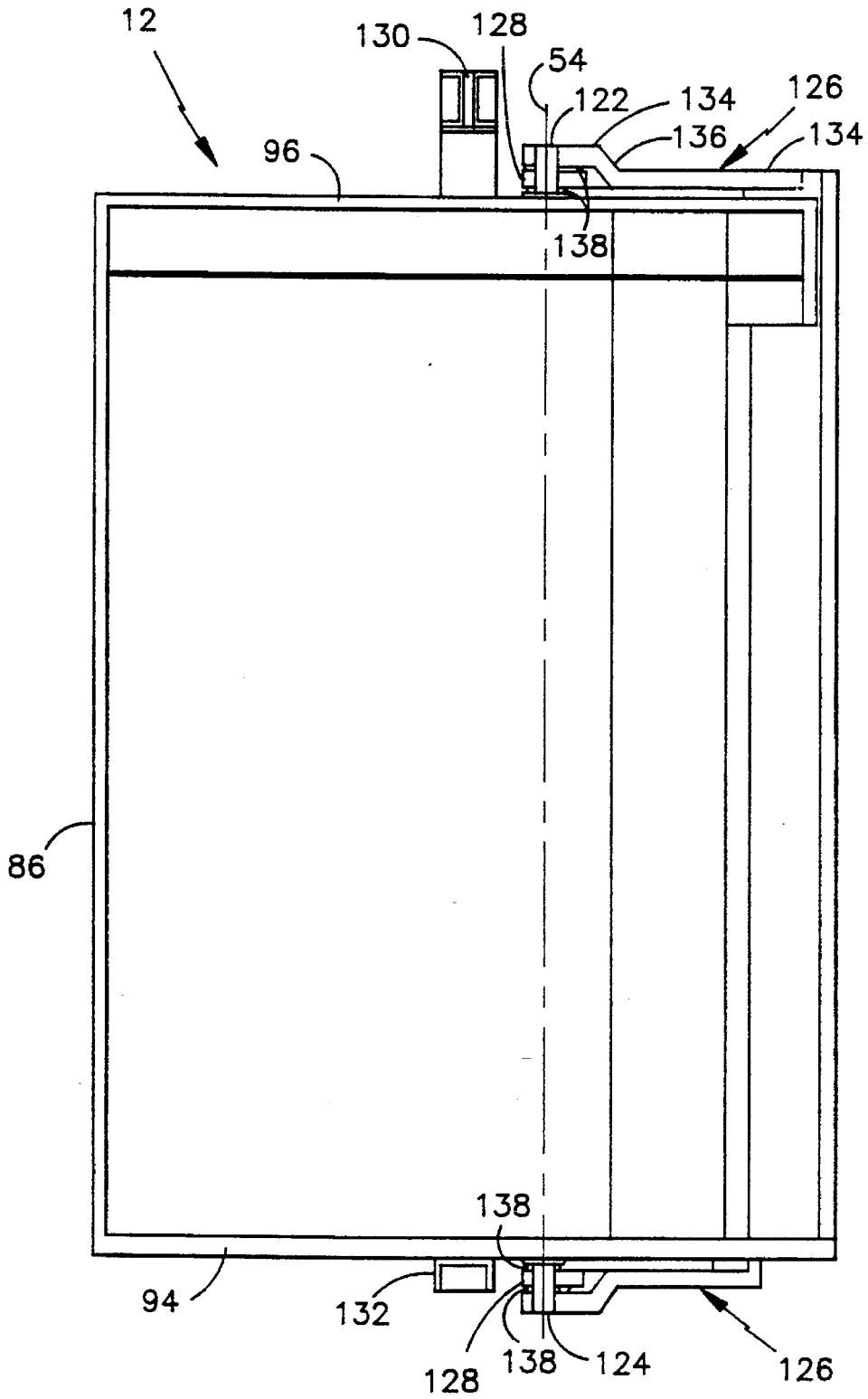
FIG. 5 is a cross-sectional partial view of FIG. 2.
Figure 6B:
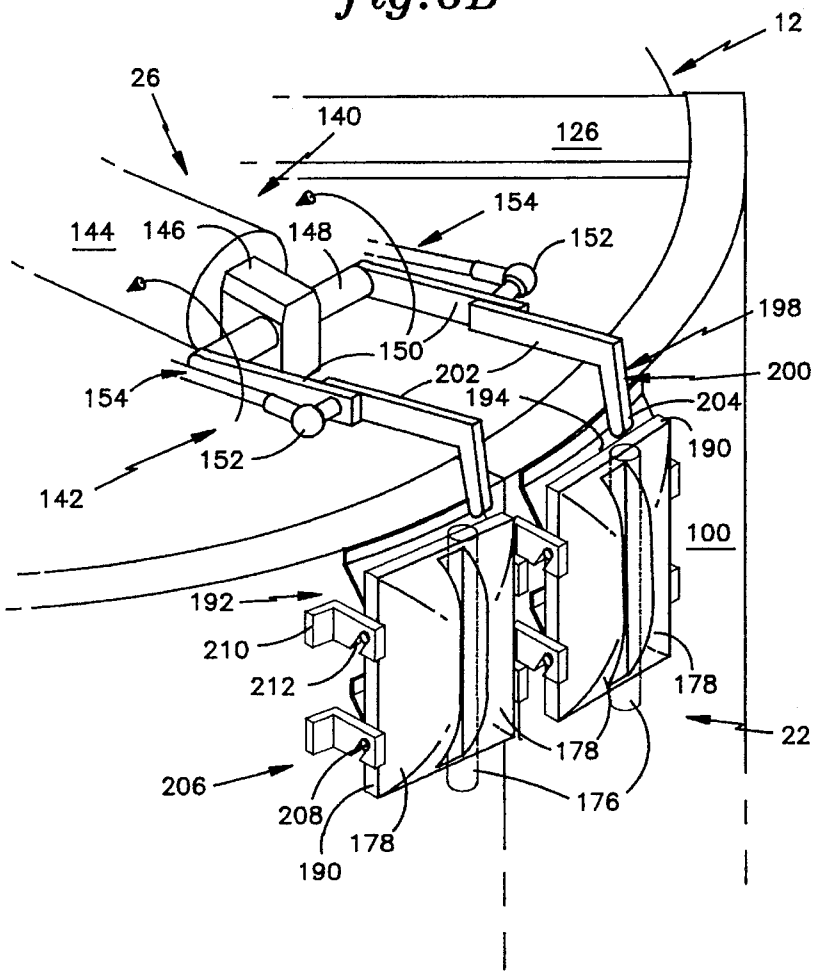
FIG. 6 is a cross-sectional partial view of FIG. 5.
Figure 6A:
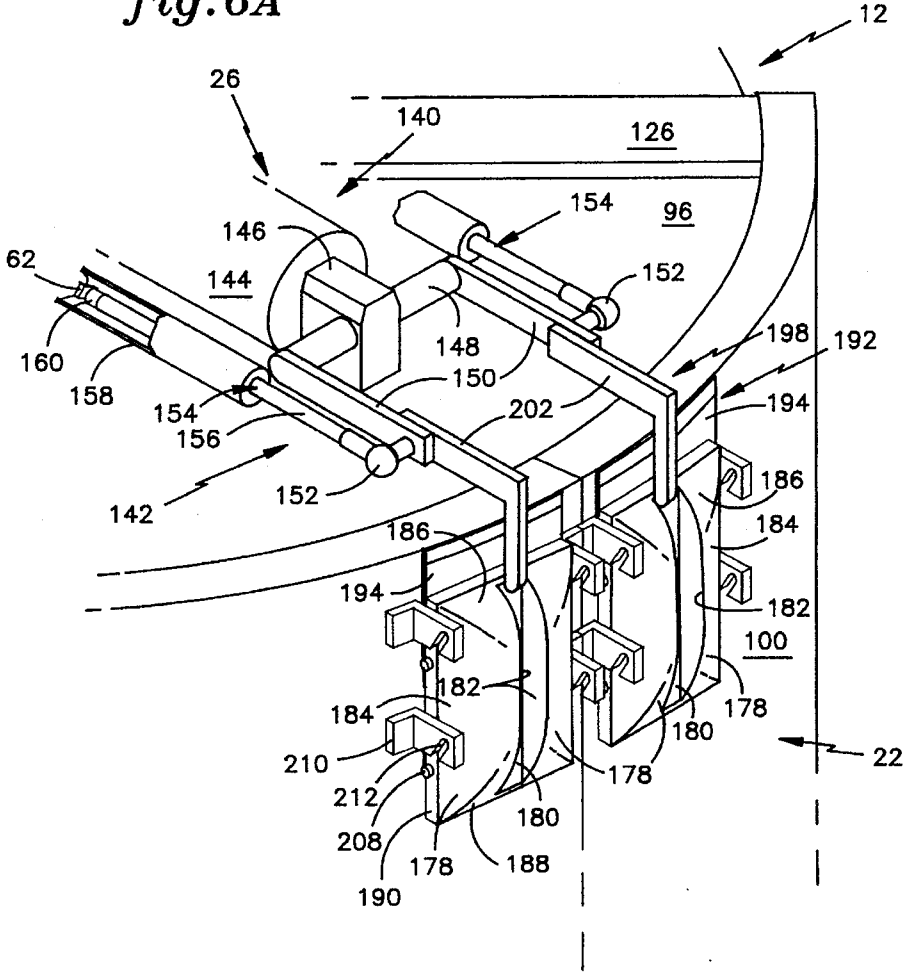
Figure 7B:
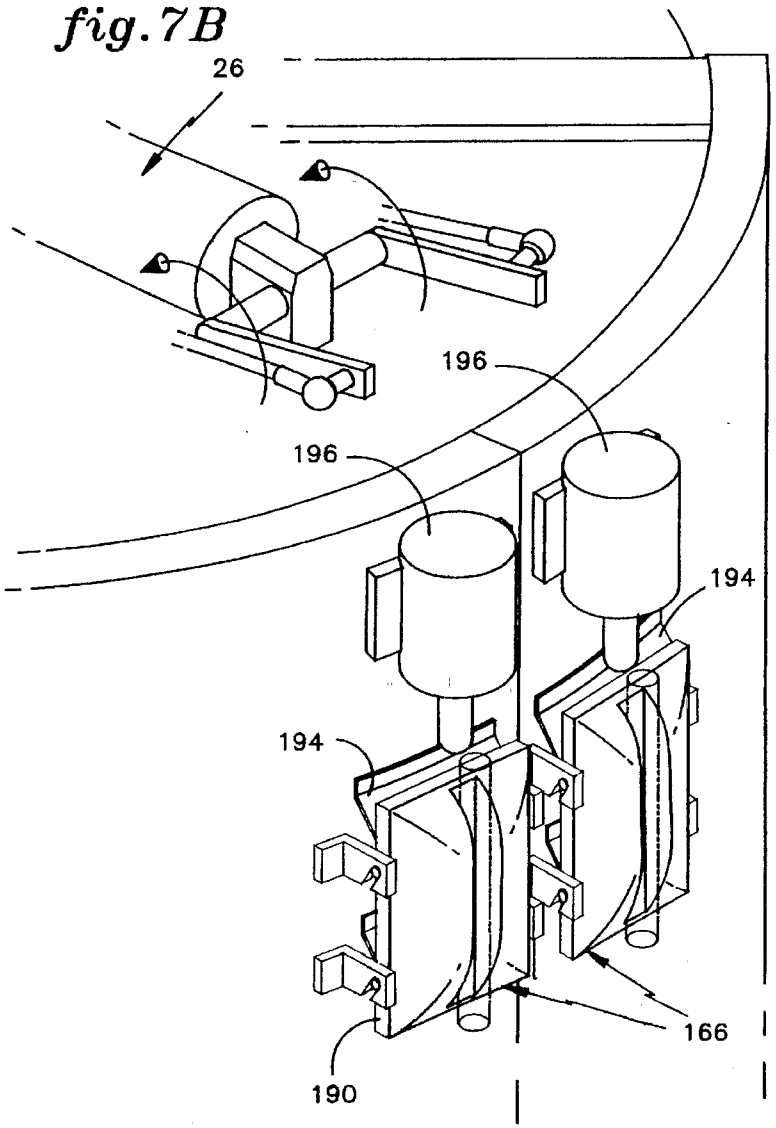
Figure 7A:
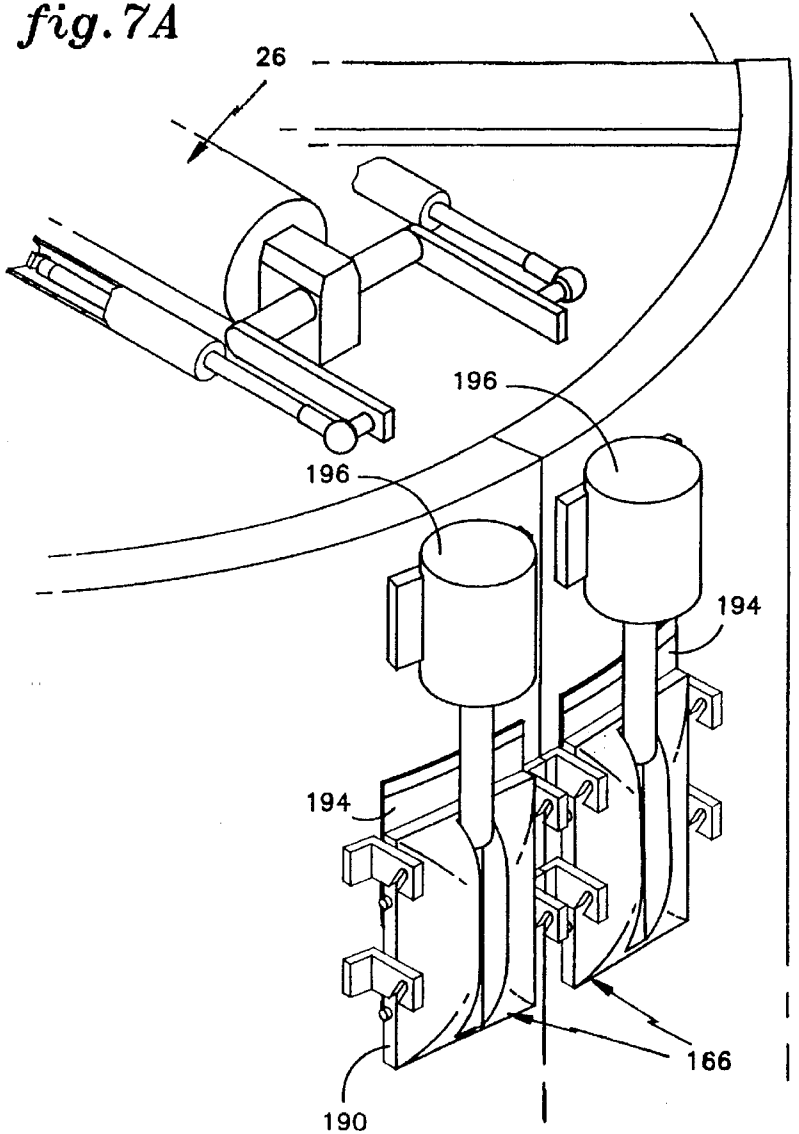
Figure 1:
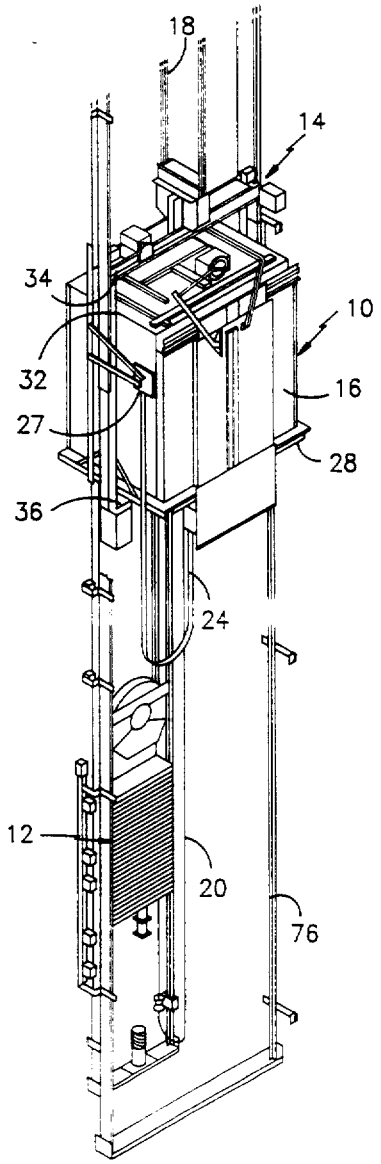
Figure 2:
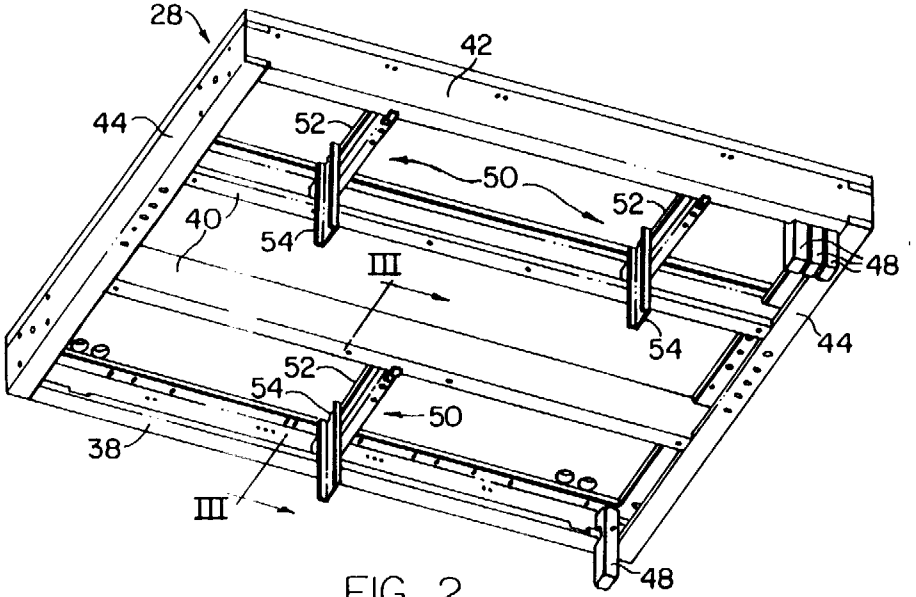
Figure 6:
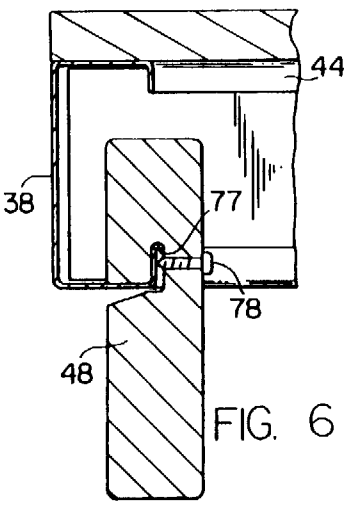
Figure 5:
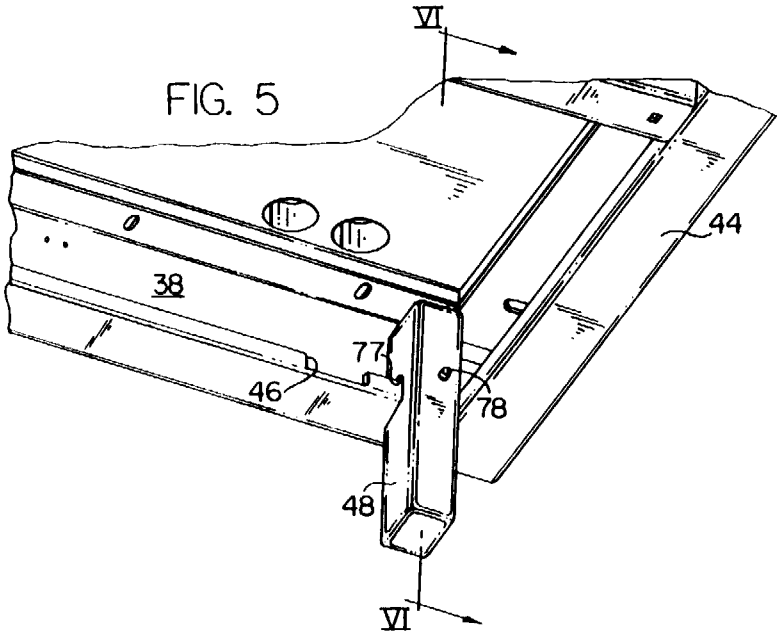

Referring to FIGS. 5 and 6, adjustable weights 48 are attached to the platform support frame 28 to shift the center of gravity of the car 10, and thereby balance the weight of the elevator car 10 relative to the rails 76 (FIG. 1). The number and size of weights 48 used will depend on weight characteristics of each car 10. A total of 200–400 pounds will generally be needed to properly balance an elevator car 10.

Each adjustable weight 48 includes a slot 77 shaped such that it can be first slid into the "C"-shape of a front 38, rear 42, or center 40 member through one of the small openings 46, and subsequently slid laterally to receive the flange of the "C"-shaped member 38,40,42. In other words, the geometry of the "C"-shaped members 38,40,42 and the slotted weights 48 is such that the weights 48 are supported by the member 38,40,42 and may be moved freely in a lateral direction to facilitate the balancing process. Each adjustable weight 48 has a tapped hole for receiving a locking bolt 78. When tightened, the locking bolt 78 secures the adjustable weight 48 in a particular position.

Operation

Referring to FIG. 1, during the initial installation and balancing of the elevator car 10 the length of the compensating ropes 20 and traveling cable 24 are established to ensure that there is sufficient length to prevent the ropes 20 or cable 24 from experiencing any binding or stress at any car/counterweight position within the hoistway. The goal is to have each rope 20 or cable 24 be able to assume its natural curve at the extremes of the car/counterweight travel. Once the proper lengths have been established, each adjustable connector 50 is positioned in the spot believed to maintain the rope 20 or cable 24 in its natural curve, before the compensating ropes 20 and traveling cable 24 are attached.

Referring to FIGS. 3 and 4, the position of each adjustable connector 50 is adjusted by first loosening the rail clips 58 connecting the beam 52 to the center member 40 and one of the front 38 or rear 42 members. Once the beam 52 is properly situated, the rail clips 58 are tightened thereby fixing the beam 52 in place. Next, the plate 54 is positioned relative to the beam 52 by loosening the clamping assembly 66 (FIG. 4) that attaches the plate 54 to the beam 52 and sliding the plate 54 along the beam 52 to the appropriate position. Once the clamping assembly 66 is retightened, the plate 54 is fixed in position. The entire process for positioning an adjustable connector 50 as described heretofore is repeated for each connector 50 used in a given embodiment. After all the adjustable connectors 50 are in place, the compensating ropes 20 and traveling cable 24 are connected to the respective plates 54.

Upon connecting the compensating ropes 20 and traveling cable 24 to the elevator car 10, the center of gravity of the car 10 is likely to be off center. Thus, adjustable weights 48, as shown in FIGS. 5 and 6, are used to help balance the car 10. The adjustable weights 48 are added, removed, and positioned on the platform support frame 28 via the small openings 46 as described heretofore. The number of weights 48 needed for a given embodiment will depend on the load weight which must be balanced and can easily be adjusted if the positioning of the compensating ropes 20 or traveling cable 24 is changed.

A person of skill in the art will recognize that it is difficult at best to connect the compensating ropes 20 and traveling cable 24 to fixed hitch locations on the platform support frame 28. One reason adjustable positioning of the compensating ropes 20 and traveling cable 24 is advantageous is that it allows the compensating ropes 20 and traveling cable 24 to hang in its natural radius, or as close to it as possible. Another reason adjustable positioning of the compensating ropes 20 and traveling cable 24 is advantageous is that it allows the ropes 20 and cables 24 to be hung in positions that minimize the chance of entanglement.

Another advantage of the present invention results from the single locking bolt 78 (FIGS. 5 and 6) necessary to attach the arrangement of the adjustable weight 48 used in balancing the elevator car 10. Given that the adjustable weight 48 hangs freely without additional support and only requires one bolt to fix its position, a worker can adjust the position of the weight using only one hand. This allows the worker greater ease in both installing the adjustable weights 48 and in balancing the elevator car 10.

A further advantage of the adjustable weight 48 results from the ease and simplicity of its design. The adjustable weight 48 is shaped such that it can hang on the platform support frame member 38,40,42 without additional support. This reduces the cost and complexity of attaching the adjustable weight 48 since no additional components are necessary. This also allows a field worker the opportunity to check the balance of the car 10 with the entire amount of weight supported on the car prior to bolting the weight in place.

Although the invention has been shown and described with respect to a best mode embodiment thereof, it should be understood by those of ordinary skill in the art that various omissions, changes and additions in the form and detail thereof may be made without departing from the spirit and scope of the invention. For example, the front 38, rear 42, and center 40 members of the platform support frame 28 have been described heretofore as having a "C"-shaped cross-section for receiving the adjustable weights and the reinforcing flanges 56 of the adjustable connector beams 52. Alternatively, other male and female geometries may be used.

We claim:

1. A method for installing an underslung cable to an elevator car, comprising the steps of:

providing an adjustable connector, attached to the elevator car, said adjustable connector having two degrees of adjustable motion;

positioning said adjustable connector in a desired position; and attaching the underslung cable to said adjustable connector.

2. A method for installing an underslung cable to an elevator car according to claim 1, wherein said adjustable connector is attached to a platform support frame of the car.

3. A method for installing an underslung cable to an elevator car according to claim 2, wherein said platform support frame comprises:

a front member, having a "C"-shaped cross-sectional profile;

a rear member, having a "C"-shaped cross-sectional profile;

a plurality of center members, each having a "C"-shaped cross-sectional profile;

wherein said adjustable connector may be positioned between one of said front or rear member and one of said center members, and may move laterally therebetween.

4. A method for installing an underslung cable to an elevator car according to claim 3, wherein said adjustable connector comprises:

a beam, wherein said beam extends between one of said front or rear member and one of said center members when installed, and may move laterally therebetween; and a plate, having means for attaching the underslung cable, wherein said plate may be moved along said beam and therefore between one of said front or rear member and one of said center members when installed.

5. A method for balancing an elevator car having an underslung cable, comprising the steps of:

providing an adjustable connector, attached to the elevator car, said adjustable connector having two degrees of adjustable motion;

positioning said adjustable connector in a desired position; and attaching the underslung cable to said adjustable connector.

6. A method for balancing an elevator car according to claim 5, further comprising the steps of:

providing an adjustable weight;

positioning said weight on the car to adjust the center of gravity of the car.

7. A method for balancing an elevator car according to claim 6, wherein said adjustable connector and said adjustable weight are attached to a platform support frame of the car.

8. A method for balancing an elevator car according to claim 7, wherein said platform support frame comprises:

a front member, having a "C"-shaped cross-sectional profile;

a rear member, having a "C"-shaped cross-sectional profile;

a plurality of center members, each having a "C"-shaped cross-sectional profile;

wherein said adjustable connector may be positioned between one of said front or rear member and one of said center members, or between a pair of said center members, and may move laterally therebetween.

9. A method for balancing an elevator car according to claim 8, wherein said adjustable connector comprises:

a beam, wherein said beam extends between one of said front or rear member and one of said center members or between a pair of said center members when installed, and may move laterally therebetween; and a plate, having means for attaching the underslung cable, wherein said plate may be moved along said beam and therefore between one of said front or rear member and one of said center members or between a pair of said center members when installed.

10. A method for balancing an elevator car according to claim 9, wherein said adjustable weight comprises:

a shaped slot, for receiving a flange of a "C"-shaped channel, said shaped slot having a geometry that maintains said weight on said car.

11. A method for balancing an elevator car according to claim 10, wherein said adjustable weight further comprises a threaded hole extending into said slot for receiving a threaded member, wherein said threaded member can be threaded into said slot and against said flange of said "C"-shaped channel to fix said weight relative to said channel.

12. An apparatus for installing an underslung cable to an elevator car, comprising:

a support platform, for supporting a cab of the elevator car;

an adjustable connector, attached to said support platform of the elevator car, said adjustable connector having two degrees of adjustable motion.

13. An apparatus for installing an underslung cable to an elevator car according to claim 12, wherein said support platform comprises:

a front member, having a "C"-shaped cross-sectional profile;

a rear member, having a "C"-shaped cross-sectional profile;

a plurality of center members, each having a "C"-shaped cross-sectional profile;

wherein said adjustable connector may be positioned between one of said front or rear member and one of said center members, and may move laterally therebetween.

14. An apparatus for installing an underslung cable to an elevator car according to claim 13, wherein said adjustable connector comprises:

a beam, wherein said beam extends between one of said front or rear member and one of said center members when installed, and may move laterally therebetween; and a plate, having means for attaching the underslung cable, wherein said plate may be moved along said beam and therefore between one of said front or rear member and one of said center members when installed.

15. An apparatus for balancing an elevator car having an underslung cable, comprising:

an adjustable connector, attached to the elevator car, said adjustable connector having two degrees of adjustable motion wherein said underslung cable can be attached to said adjustable connector.

16. An apparatus for balancing an elevator car according to claim 15, further comprising:

an adjustable weight, wherein said weight may be positioned on the car to adjust the center of gravity of the car.

17. An apparatus for balancing an elevator car according to claim 16, further comprising:

a platform support frame, for supporting a cab of the elevator car;

wherein said adjustable connector and said adjustable weight are attached to said platform support frame.

18. An apparatus for balancing an elevator car according to claim 17, wherein said platform support frame comprises:

a front member, having a "C"-shaped cross-sectional profile;

a rear member, having a "C"-shaped cross-sectional profile;

a plurality of center members, each having a "C"-shaped cross-sectional profile;

wherein said adjustable connector may be positioned between one of said front or rear member and one of said center members, and may move laterally therebetween.

19. An apparatus for balancing an elevator car according to claim 18, wherein said adjustable connector comprises:

a beam, wherein said beam extends between one of said front or rear member and one of said center members when installed, and may move laterally therebetween; and a plate, having means for attaching the underslung cable, wherein said plate may be moved along said beam and therefore between one of said front or rear member and one of said center members when installed.

20. An apparatus for balancing an elevator car according to claim 19, wherein said adjustable weight comprises:

a shaped slot, for receiving a flange of a "C"-shaped channel, said shaped slot having a geometry that maintains said weight on said car.

21. An apparatus for balancing an elevator car according to claim 20, wherein said adjustable weight further comprises a threaded hole extending into said slot for receiving a threaded member, wherein said threaded member can be threaded into said slot and against said flange of said "C"-shaped channel to fix said weight relative to said channel.

* * * * *

UNITED STATES PATENT AND TRADEMARK OFFICE

CERTIFICATE OF CORRECTION

PATENT NO. : 5,492,201
DATED : February 20, 1996
INVENTOR(S) : Richard J. Ericson, et. al.

It is certified that error appears in the above-identified patent and that said Letters Patent is hereby corrected as shown below:

The title page should be deleted and substitute therefor the attached title page.

Drawings:

Delete sheets 1-7 of the drawings and insert the attached 4 sheets of drawings.

Signed and Sealed this

Thirteenth Day of August, 1996

*Attest:*

*Attesting Officer*

BRUCE LEHMAN

*Commissioner of Patents and Trademarks*

United States Patent [19]

Ericson et al.

[11] Patent Number: 5,492,201

[45] Date of Patent: Feb. 20, 1996

[54] METHOD AND APPARATUS FOR INSTALLING AND BALANCING AN ELEVATOR CAR

[75] Inventors: Richard J. Ericson, Southington, Conn.; T. Thomas Suchodolski, Ware, Mass.; Minglun Qiu, Bloomington, Ind.

[73] Assignee: Otis Elevator Company, Farmington, Conn.

[21] Appl. No.: 298,482

[22] Filed: Aug. 29, 1994

[51] Int. Cl.[6] ..... B66B 11/02; B66B 11/08

[52] U.S. Cl. ..... 187/401; 187/408; 187/412; 187/414

[58] Field of Search ..... 187/401, 405, 187/408, 412, 414

[56] References Cited

U.S. PATENT DOCUMENTS

| | | | |
|---|---|---|---|
| 808,042 | 12/1905 | Gould | 187/401 X |
| 4,716,989 | 1/1988 | Coleman et al. | 187/414 X |

FOREIGN PATENT DOCUMENTS

| | | | |
|---|---|---|---|
| 5246650 | 9/1993 | Japan | 187/401 X |

*Primary Examiner*—William E. Terrell
*Assistant Examiner*—Dean A. Reichard

[57] ABSTRACT

A method and an apparatus for installing and balancing an elevator car is disclosed. The method for installing and balancing an elevator car situated in a hoistway where cables attach to the car, is characterized by the following steps: providing an adjustable connector attached to the elevator car having two degrees of adjustable motion; positioning the connector to a desired location underneath the car, connecting the cables to the adjustable connector, and balancing the elevator car with an adjustable weight which is also attached to the underside of the elevator car. The apparatus for installing and balancing an elevator car having cables attached to its underside includes: (1) an adjustable connector attached to the elevator car having two degrees of adjustable motion; and, (2) an adjustable weight which attaches to the underside of the elevator car and is used to balance the car.

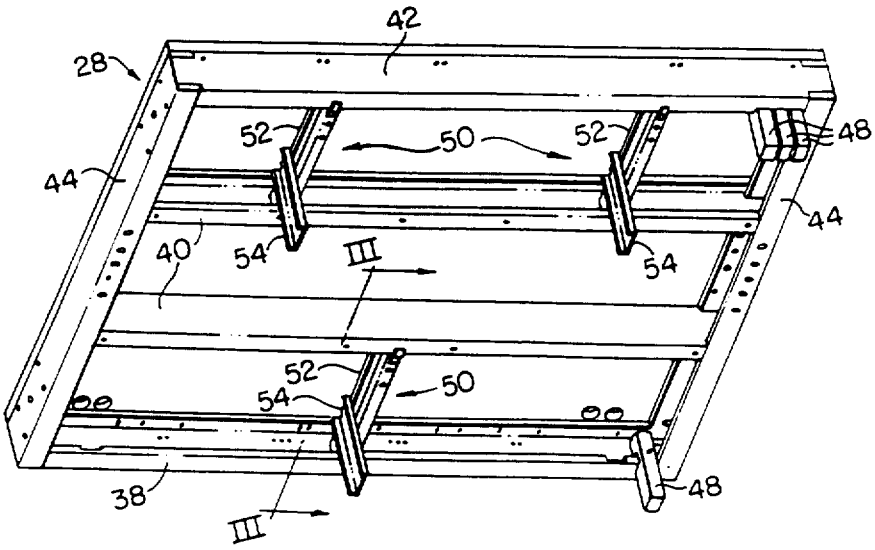

21 Claims, 7 Drawing Sheets